US005957139A

United States Patent [19]

Bolli

[11] Patent Number: 5,957,139

[45] Date of Patent: Sep. 28, 1999

[54] METHOD OF PRODUCING A WIG FOR A TOY FIGURE

[75] Inventor: Peter Bolli, Hagendorn, Switzerland

[73] Assignee: INTERLEGO AG, Baar, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/836,946

[22] PCT Filed: Nov. 20, 1995

[86] PCT No.: PCT/EP95/04569

§ 371 Date: May 21, 1997

§ 102(e) Date: May 21, 1997

[87] PCT Pub. No.: WO96/15839

PCT Pub. Date: May 30, 1996

[30] Foreign Application Priority Data

Nov. 24, 1994 [CH] Switzerland ..... 3546/94

[51] Int. Cl.[6] ..... A41G 3/00; A63H 3/44

[52] U.S. Cl. ..... 132/56

[58] Field of Search ..... 446/394; 132/53, 132/56, 201, 54, 55

[56] References Cited

U.S. PATENT DOCUMENTS

| | | | |
|---|---|---|---|
| 1,090,198 | 3/1914 | Butler . | |
| 2,636,460 | 4/1953 | Saiderman | 132/201 |
| 2,697,304 | 12/1954 | Welch . | |
| 2,814,301 | 11/1957 | Schmitz . | |
| 2,820,326 | 1/1958 | Cohn et al. | 446/394 |
| 3,162,203 | 12/1964 | Cramer | 446/394 X |
| 3,199,516 | 8/1965 | Frishman . | |
| 3,421,521 | 1/1969 | Rich . | |
| 3,533,419 | 10/1970 | Lenoble | 132/56 |
| 3,645,276 | 2/1972 | Cho . | |
| 3,654,935 | 4/1972 | Brown . | |
| 3,670,741 | 6/1972 | Utsunomiy . | |
| 3,716,165 | 2/1973 | Finamore . | |
| 3,722,517 | 3/1973 | Molinario . | |
| 3,903,903 | 9/1975 | Matsumura | 132/201 |
| 3,977,335 | 8/1976 | Bonham | 132/201 |
| 4,070,790 | 1/1978 | Strongin et al. . | |
| 4,606,359 | 8/1986 | Palumbo et al. . | |
| 4,616,769 | 10/1986 | Steigler et al. . | |
| 4,674,169 | 6/1987 | Katzman et al. | 446/394 X |
| 4,817,641 | 4/1989 | Kobayshi et al. . | |
| 4,865,057 | 9/1989 | Braun . | |
| 4,930,527 | 6/1990 | Makishima et al. . | |
| 5,657,774 | 8/1997 | Niese . | |

FOREIGN PATENT DOCUMENTS

| | | |
|---|---|---|
| 326068 | 11/1975 | Austria . |
| 1146400 | 11/1957 | France . |

*Primary Examiner*—Todd E. Manahan

*Attorney, Agent, or Firm*—Kane, Dalsimer, Sullivan, Kurucz, Levy, Eisele and Richard, LLP

[57] ABSTRACT

Threads of hair are embroidered in loops on a flat, flexible base, for example, a textile base, in an area bounded by a desired wig contour. Individual threads or tufted multiple threads are embroidered in loops. Thereafter, the embroidered area is removed from the base along with the wig contour by cutting or punching. The flexible wig is glued onto a doll's head, cut to length and combed.

18 Claims, 3 Drawing Sheets

METHOD OF PRODUCING A WIG FOR A TOY FIGURE

The present invention relates to a method to produce a wig which can be glued onto a body part of a toy figure, in particular onto a doll's head, and to a body part of a toy figure, in particular a doll's head, with a glued-on wig.

It is known to provide a doll's head with hair by sewing tufts of hair into the head part of the doll. For this purpose, the material of the doll's head must be comparatively soft in order to be able to be pierced by the sewing needle. These soft materials have the disadvantage that the holes pierced by the sewing needle easily tear out, such that the sewn-in tufts of hair are badly anchored. Moreover, in such a material, the surface can only be painted or printed in a difficult and less durable manner. The same disadvantages also exist in other toy figures to be provided with hair, for example in a toy horse which is to be provided with a mane or a tail.

The said disadvantages of a toy figure, in particular a doll's head, consisting of a soft plastic material and to be fitted with hair can be avoided by a wig of hair being glued onto a body of the toy figure, consisting of any other desired material, or onto such a doll's head.

Such a wig of hair and its manufacture are described in FR-A-1,146,400. In one embodiment, a fabric of weft and warp threads is formed. The warp threads run only in the centre of the fabric and only a few warp threads at the two edges. The central part of such a piece of fabric is glued onto a doll's head along its longitudinal centre line, and the region of the warp threads is subsequently trimmed at the edges. Since the weft threads are all oriented in the same direction, this wig does not, however, have a very natural appearance.

It is therefore the object of the present invention to provide a method of the type mentioned at the beginning, which is simple and cost-effective, and which provides a sturdy wig of natural appearance for a doll (or a different toy figure) of any desired size, that is to say in particular of small size.

According to the invention, this object is achieved in that threads of hair are stitched in loops on a flat, flexible base in an area bounded by a desired wig contour, and in that, afterwards, the stitched area is removed from the base along the wig contour.

By carrying out an stitching operation on a flat, flexible base, a hair style of any desired appearance and any size and shape can be produced by machine in a simple manner. This wig can subsequently be bonded without difficulty onto the body part of a toy figure, in particular onto the doll's head, consisting of a user-friendly and environmentally compatible material.

Exemplary embodiments of the method according to the invention are described below with reference to the drawings in the application on a doll's head. It is understood that the same method steps can also be applied to producing hair for other toy figures, in which case the contour of the wig mentioned in the following naturally has to be adapted to the respective body part of the toy figure. In the drawings, FIG. 1 shows a view of a contour, marked on a base by stitching, of a wig to be glued onto a doll's head;

Figure 1:
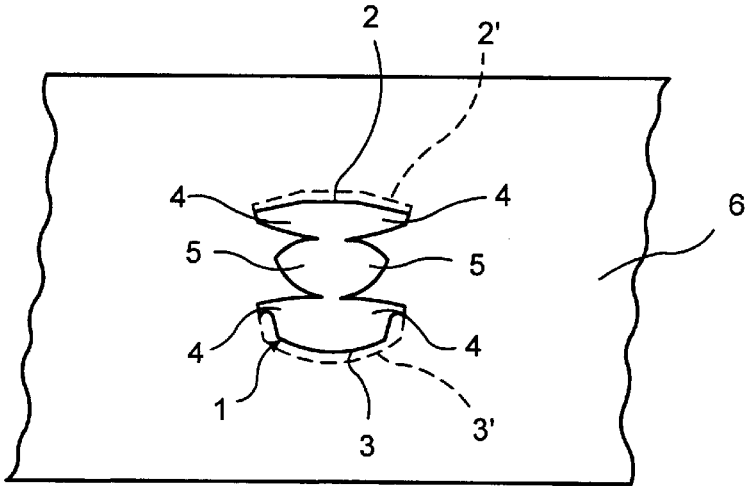

In a first embodiment of the method according to the invention, the contour 1 of the wig to be produced and to be glued onto a doll's head is stipulated according to FIG. 1. The contour 1 naturally depends on the shape and the size of the doll's head to be provided with the wig. In the example illustrated, it has a front part 2, a neck part 3 and four flaps 4 which bound two larger flaps 5 and come to rest against one another when the wig has been placed on the doll's head.

The stipulated contour 1 is marked on a flat base 6, illustrated as an extract, by being stitched on the base 6. The base 6 is to be flexible and can be made of textile, that is to say a web of fabric. However, it is also possible to use a base of fibrous structure, for example based on paper, or a base made of a plastic material. The stitching of the contour 1 expediently takes place on an embroidery machine which is known per se.

A further possibility of stitching the contour 1 consists in that the front part 2 and the neck part 3 and additional contours 2' and 3' are stitched using a buttonhole stitching operation, which is illustrated by dashed lines in FIG. 1. Afterwards, the portions of the base 6 between the stitched parts 2, 2' and 3, 3' is removed such that the two regions bounded by the stitched parts 2 and 2' and the stitched parts 3 and 3' resemble a buttonhole. Removal of the portions of the base 6 between the stitched parts 2 and 2' and the stitched parts 3 and 3' can be accomplished by the embroidery machine itself since well-equipped embroidery machines having drilling devices which are capable of removing material from a workpiece. It is also possible to stitch the two larger flaps 5 additionally or solely using a buttonhole stitching operation (not illustrated) and subsequently remove them, at least partially, from the portion of the base 6 outside of the contour 1 using one of the aforementioned drilling devices. This embodiment of the contour 1 has the advantage that the later cutting-out of the embroidered wig from the base 6 is facilitated. The purpose of only partially drilling free the parts 2, 2' and 3, 3' or the larger flaps 5 is to prevent the base 6 from stretching or distorting because of stitching the threads of wig hair or tufts of hair described below.

Figure 2:
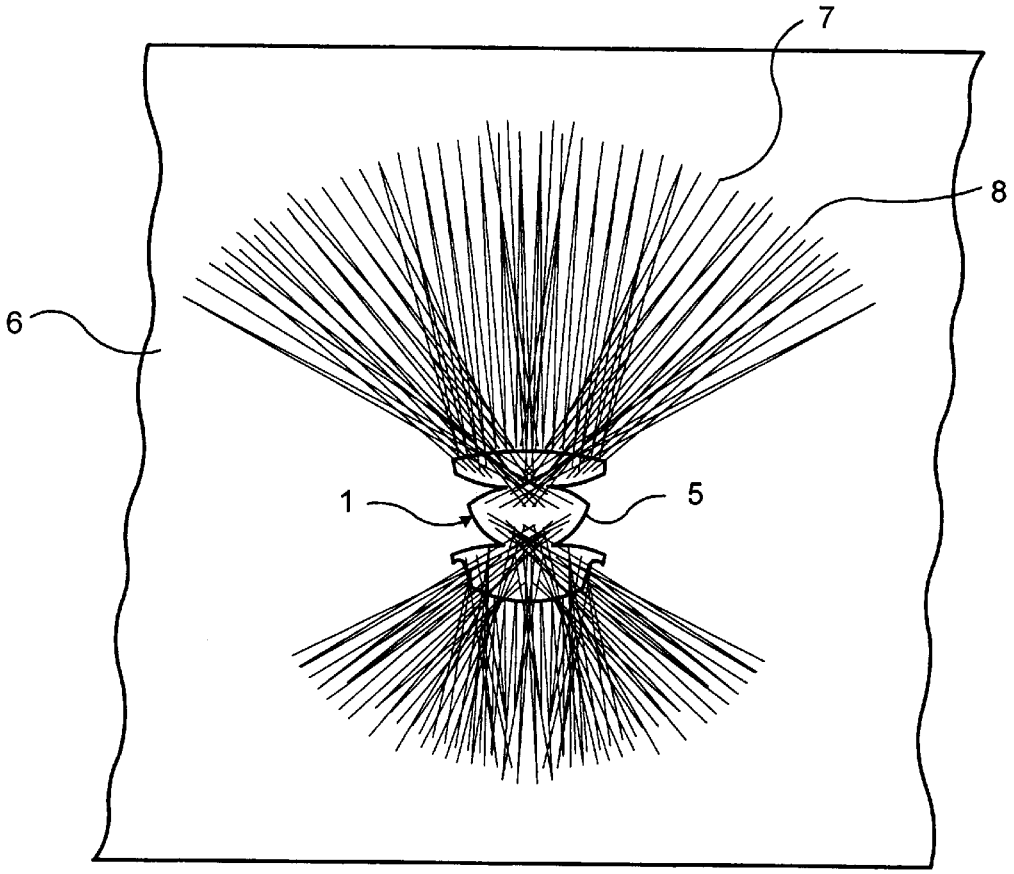
FIG. 2 shows a diagrammatic view of threads or tufts of hair stitched in loops of different lengths within the marked contour of FIG. 1.

In a second method step, according to FIG. 2 threads or tufts of hair 7 and 8 are stitched in loops in the area of the base 6 bounded by the contour 1 of FIG. 1. In this case, the threads or tufts are firstly sewn onto the base 6 within the contour 1, are then pulled radially outwards and are sewn onto the base 6 outside the contour 1, after which they are pulled back into the area within the contour 1 and there they are again sewn onto the base 6. In this way, all the threads or tufts of hair 7 and 8 are stitched successively onto the base 6.

The loops of threads or tufts of hair 7, 8 can all be of equal length or, as illustrated in FIG. 2, can have different lengths. Since, as will be mentioned below, the loops of threads or tufts of hair are cut to length after the wig has been glued onto the doll's head, their length must be greater than the desired hair length. If the hair is intended to be a kind of "mop of fuzzy hair", the threads or tufts of hair, which will possibly not be cut, will be stitched in an appropriate length.

The stitching of the threads or tufts of hair 7, 8 also expediently takes place using an embroidery machine. The material used for the threads of hair is preferably polyamide or another polymer which can be dyed as desired. In this case, the threads or tufts can be smooth or textured.

Figure 3:
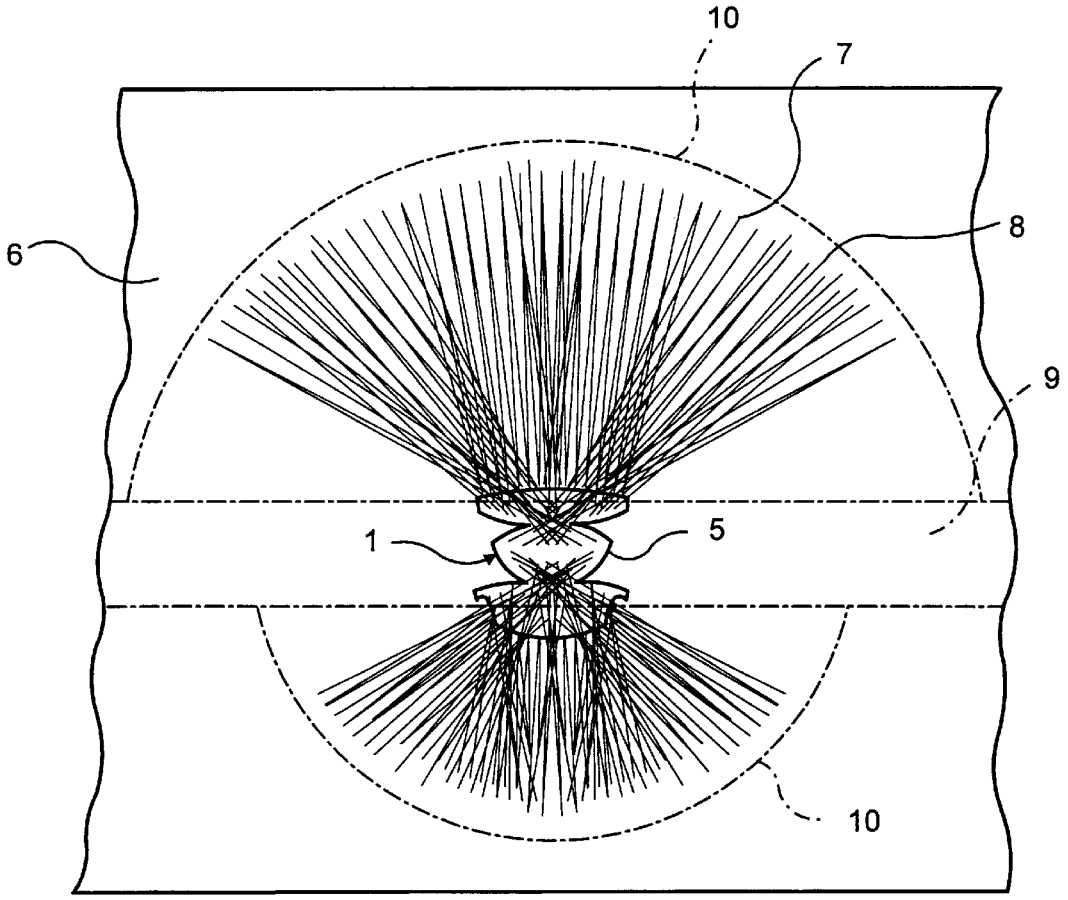
FIG. 3 shows a diagram of cut-out or punch-out steps carried out in the base to separate the area stitched within the contour according to FIG. 2 from the base.

In a third method step, with reference to FIG. 3, the area, bounded by the contour 1 and stitched with the threads or tufts of hair 7, 8, is removed from the base 6 surrounding the contour 1. For this purpose, lateral strips 9, for example, are firstly cut or punched out of the base 6, which strips extend up to the larger flaps 5 of the contour 1. Afterwards, the base 6 is folded down along the strip-shaped larger flaps obtained. This allows the stitched area to be cut or punched out of the base 6 completely along the contour 1, for which purpose the procedure may, for example, be as follows: the part of the base 6 located outside the actual stitching area is separated by cutting or punching out along semicircular lines 10. Afterwards, the base 6 can be cut or punched along the contour 1 between the remaining base 6 and the stitched threads or tufts of hair 7, 8, which has the advantage that the loop tips remain anchored on the semicircular surface and thus cannot become entangled. Not until the end are the loop tips separated from the remaining base 6. The said cutting or punching out advantageously takes place by machine directly before the wig is placed on the doll's head.

The cutting or punching out of the stitched wig from the base 6 is simpler if the front part 2 and the neck part 3, as explained above and illustrated in FIG. 1, and/or, if appropriate, the flaps 5 are embroidered in the manner of a buttonhole and are drilled free, as discussed above. It is then essentially only necessary to cut or punch the lateral strips 9.

Figure 4:
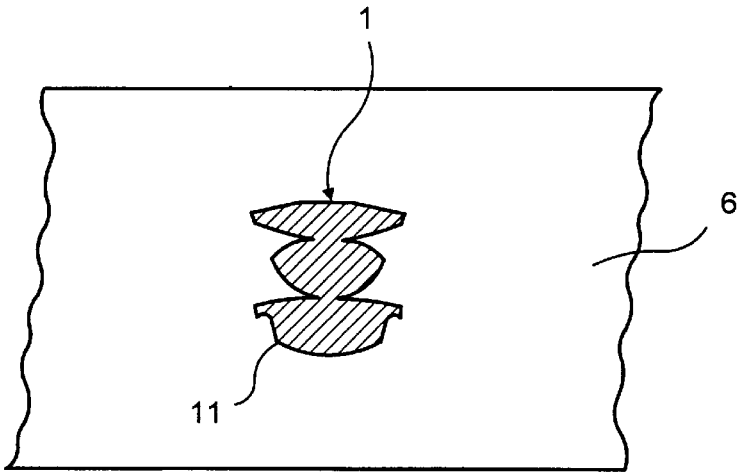
FIG. 4 shows a view of a basic area, defined by stitching on a base, of a wig to be glued onto a doll's head.

In accordance with a variant of the method, the above-mentioned cutting or punching out of the stitched area of the base 6 along the contour 1 can be avoided. For this purpose, in accordance with FIG. 4, the entire area 11 of the base 6, to be stitched with threads or tufts of hair and having the contour 1, is stitched, after which, in accordance with FIG. 2, the threads or tufts of hair 7, 8 are stitched in loops. The base 6 can then be removed in a further method step by chemical and/or thermal methods from the area 11 provided with the threads or tufts of hair.

Since an embroidery machine normally has a large number of needles, similarly a large number of stitching operations can be carried out at the same time, which keeps the production costs very low.

Figure 5:
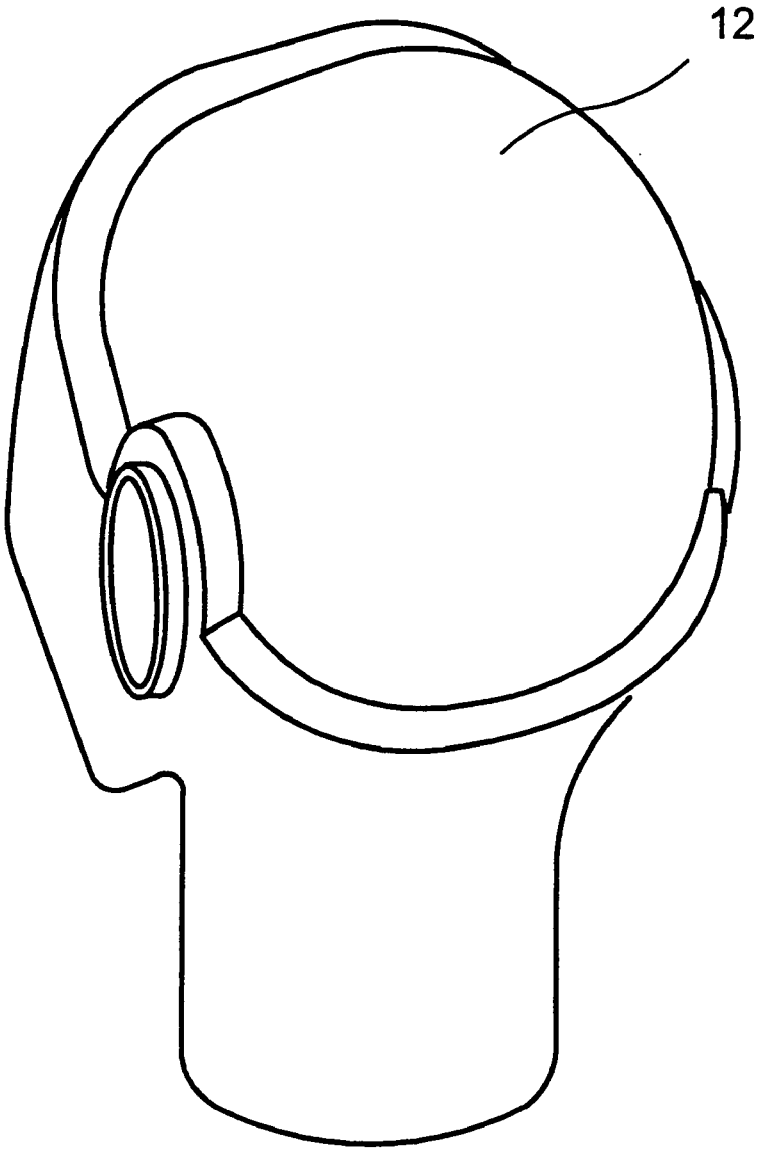
FIG. 5 shows a diagrammatic view of a doll's head with a depression to receive the area, shown in FIG. 3, which has been stitched and removed from the base.

The wig produced in accordance with the abovementioned examples of the method is subsequently glued onto the intended doll's head. The latter preferably consists of a plastic material, for example polystyrene. Furthermore, the doll's head is advantageously provided, during its manufacture, with a depression 12 which can be seen in FIG. 5. As a result, on the one hand the positioning of the wig when it is being glued on is facilitated and, on the other hand, a smooth transition from the uncovered surface of the doll's head to the stitched base of the wig is achieved. The threads or tufts of hair of the glued-on wig can then be cut to length and combed as required.

In addition to the simple production operations which can easily be adapted to the respective requirements in relation to the shape and appearance of the wig, the method according to the invention has the advantage of being able to achieve a thick covering of hair without bald places.

I claim:

1. A method to produce a wig which can be glued onto a body part of a toy figure, comprising the steps of:

stitching threads of hair in loops on a flat, flexible base alternatingly in an area bounded by a desired wig contour and in an area outside said wig contour; and removing the stitched area from the base along the wig contour.

2. The method according to claim 1, wherein a textile base is used as the flexible base.

3. The method according to claim 1, wherein synthetic threads are used as threads of hair.

4. The method according to claim 3, wherein individual threads are stitched in loops on the base.

5. The method according to claim 4, wherein threads of at least one of different colors and different loop length are stitched on the base.

6. The method according to claim 3, wherein tufted multiple threads are stitched in loops on the base.

7. The method according claim 1, wherein the desired wig contour is marked on the base.

8. The method according to claim 1 wherein a plurality of adjacently located areas bounded in each case by a wig contour are stitched simultaneously with threads of hair along said base, and wherein the stitched areas are removed from the base along the wig contours.

9. The method to claim 1 wherein the stitched threads of hair are cut to length after the wig has been glued onto the doll's head.

10. A method to produce a wig which can be glued onto a body part of a toy figure, comprising the steps of:

stitching thread of hair in loops on a flat, flexible base in an area bounded by a desired wig contour; and removing the stitched area from the base along the wig contour;

wherein the desired wig contour is marked on the base and is stitched in lines for marking.

11. The method according to claim 10 wherein areas of the contour are stitched using a buttonhole stitching operation and wherein the areas stitched using a buttonhole stitching operation are subsequently at least partially removed from the portion of the flexible base outside of the wig contour.

12. The method according to claim 11 wherein a front part and a neck part of the contour are stitched with further contours using a buttonhole stitching operation.

13. The method according to claim 11, wherein flaps of the contour are stitched using a buttonhole stitching operation.

14. A method to produce a wig which can be glued onto a body part of a toy figure, comprising the steps of:

stitching threads of hair in loops on a flat, flexible base in an area bounded by a desired wig contour; and removing the stitched area from the base along the wig contour;

wherein, to remove the stitched area from the base, firstly two strips, located opposite one another relative to the stitched area and extending up to the wig contour, are cut out of the base, and, afterwards, the surrounding area of the base is cut away up to the wig contour by raising the threads of hair stitched in loops.

15. The method according to claim 14 wherein a front part and a neck part of the contour are stitched with further contours using a buttonhole stitching operation and wherein the portions of the flexible base between said front part and its corresponding further contour and between said neck part and its corresponding further contour are removed, partially detaching the front part and the neck part from the portion of flexible base outside of the wig contour, so that when the strips extending up to the wig contour are cut out, the front part and the neck part are simultaneously completely detached from the portion of the flexible base outside of the wig contour.

16. The method according to claim 14 wherein flaps of the contour are stitched using a buttonhole stitching operation and wherein said flaps are at least partially removed from the portion of the flexible base outside of the wig contour so that when the strips extending up to the wig contour are cut out, the flaps are simultaneously completely detached from the portion of the flexible base outside of the wig contour.

17. The method according to one of claim 14, wherein the cutting out takes place by punching out.

18. A method to produce a wig which can be glued onto a body part of a toy figure, comprising the steps of:

stitching threads of hair in loops on a flat, flexible base in an area bounded by a desired wig contour; and removing the stitched area from the base along the wig contour;

wherein the area bounded by the desired wig contour is stitched on the base, after which the threads of hair are stitched in loops on this area, and wherein, afterwards, the base is removed from the area stitched with the threads of hair by treating the base with at least one of chemicals or heat.

* * * * *